US012280292B2

(12) United States Patent
Reyes

(10) Patent No.: US 12,280,292 B2
(45) Date of Patent: Apr. 22, 2025

(54) ADJUSTABLE SUPPORT PAD

(71) Applicant: Osvaldo Reyes, Atwater, CA (US)

(72) Inventor: Osvaldo Reyes, Atwater, CA (US)

( * ) Notice: Subject to any disclaimer, the term of this patent is extended or adjusted under 35 U.S.C. 154(b) by 107 days.

(21) Appl. No.: 18/362,659

(22) Filed: Jul. 31, 2023

(65) Prior Publication Data

US 2024/0075337 A1 Mar. 7, 2024

Related U.S. Application Data

(63) Continuation of application No. 29/877,772, filed on Jun. 12, 2023.

(60) Provisional application No. 63/374,783, filed on Sep. 7, 2022.

(51) Int. Cl.
*A63B 21/00* (2006.01)

(52) U.S. Cl.
CPC ..... *A63B 21/4039* (2015.10)

(58) Field of Classification Search
CPC ... A63B 21/153; A63B 21/154; A63B 21/155; A63B 21/156; A63B 21/157; A63B 21/02; A63B 21/023; A63B 21/025; A63B 21/04; A63B 21/0442; A63B 21/4033; A63B 21/4034; A63B 21/4035
See application file for complete search history.

(56) References Cited

U.S. PATENT DOCUMENTS

| | | | | | |
|---|---|---|---|---|---|
| 2,792,875 | A * | 5/1957 | Pirrone | A47C 1/16 | 297/130 |
| 3,065,031 | A * | 11/1962 | Henry | A47C 7/185 | 297/DIG. 1 |
| 4,953,857 | A | 9/1990 | Lemire | | |
| 5,007,633 | A | 4/1991 | Lemire | | |
| 5,584,786 | A * | 12/1996 | Almeda | A63B 23/0211 | 482/142 |
| 5,692,246 | A * | 12/1997 | Benedick | A41D 13/1245 | 2/92 |
| D420,408 | S | 2/2000 | Santimaw | | |
| 6,726,278 | B1 | 4/2004 | Albright et al. | | |
| 9,174,081 | B2 | 11/2015 | Cecil | | |
| 10,682,936 | B1 | 6/2020 | Hillenbrand | | |
| 2012/0002366 | A1 | 1/2012 | Ohnuki et al. | | |
| 2012/0023663 | A1* | 2/2012 | Batiste | A47C 7/425 | 5/657 |

* cited by examiner

*Primary Examiner* — Zachary T Moore

(57) ABSTRACT

A support pad having a body and an attachment mechanism is described herein. The support pad may be made of a non-slip vinyl and adapted for use with weightlifting structures. The attachment mechanism may be a pair of straps that are threaded through a series of loops on each end of the support pad, each strap having an adjustable buckle to allow the strap to be loosened and tightened. The body of the support pad may have an L-shaped lip, the outer portion of the lip forming a curved surface. The inner portion of the lip may be covered with a corner bracket, the corner bracket further having an auxiliary attachment mechanism. The auxiliary attachment mechanism may be a secondary pair of straps, each of the auxiliary straps further having an adjustable buckle and ending in a hook.

17 Claims, 9 Drawing Sheets

ADJUSTABLE SUPPORT PAD

FIELD OF THE INVENTION

The present invention relates generally to exercise gear and padding. More specifically, the present invention is an adjustable pad intended to retrofit onto existing exercise structures and assemblies.

BACKGROUND OF THE INVENTION

The hip thrust exercise is often done on a workout bench, which is not typically designed to accommodate this exercise. Trying to perform exercises such as the hip thrust on a surface not intended for them can result in risk to the user or inefficient, ineffective exercise. However, creating dedicated assemblies and benches for such exercises is costly and is an inefficient use of space in workout areas such as gyms. There is thus an existing need for a portable, adjustable means of support for use in specialized exercises such as the hip thrust.

The present invention aims to remedy this problem by providing a convenient, portable support pad that is designed to retrofit onto existing weight benches and other exercise assemblies. The present invention is a non-slip pad that provides back support when performing exercises such as a hip thrust and is especially helpful for stabilizing and supporting the user when they are using heavy weights.

In the ideal embodiment, the non-slip pad has two adjustable straps that are designed to easily attach and detach from existing assemblies. Each adjustable strap has an adjustment buckle that allows for convenient adjusting of the length of the straps to allow the pad to be secured to a variety of existing assemblies. The front of the pad may comprise an lip having an inner portion and an outer portion. The inner portion of the lip may comprise an L-shape that is adapted to fit onto the corner of a bench or similar structure, while the outer portion of the lip may be a curved surface against which a user can rest their back during exercise. In some embodiments, the present invention may further comprise a corner bracket and an auxiliary attachment system to assist in attaching the support pad to a weight bench or other surface, such as a chair, coffee table, park bench, or any other similar surface. The auxiliary attachment system may comprise one or more additional auxiliary straps, each auxiliary strap being attached at one end to an auxiliary hook. The auxiliary hook can assist in latching the pad onto a weight bench or other surface to help anchor the support pad in place.

The present invention thus provides an inexpensive, portable, and easily adjustable pad to provide support exercises such as the hip-thrust.

DETAILED DESCRIPTIONS OF THE INVENTION

All illustrations of the drawings are for the purpose of describing selected versions of the present invention and are not intended to limit the scope of the present invention.

It should be understood that as used in this document, the articles "a", "an", and "the", should be understood to include the meanings of including one or more of the subject. For example, the phrase "an attachment mechanism" should be understood to include the definition of "at least one attachment mechanism".

The present invention is a support pad 100 that comprises a body and an attachment mechanism.

Referring now to FIGS. 1-9, in the ideal embodiment, the body of the support pad 100 is comprised of non-slip vinyl that encases a hard foam padding 140 on the interior of the body. The non-slip vinyl coats the exterior of the body of the pad to help prevent the pad from slipping when it is in use. Non-slip vinyl is chosen as a material because it is industry standard, prevents slipping, and is easy to clean. Though non-slip vinyl is used in the ideal embodiment, other materials that accomplish a similar purpose and having similar properties are contemplated by alternate embodiments. In the ideal embodiment, the hard foam padding 140 is made of a soft but dense material. The soft but dense material should be dense enough to support a person's weight without unduly deforming, but soft enough to be comfortable for the user.

Figure 1:
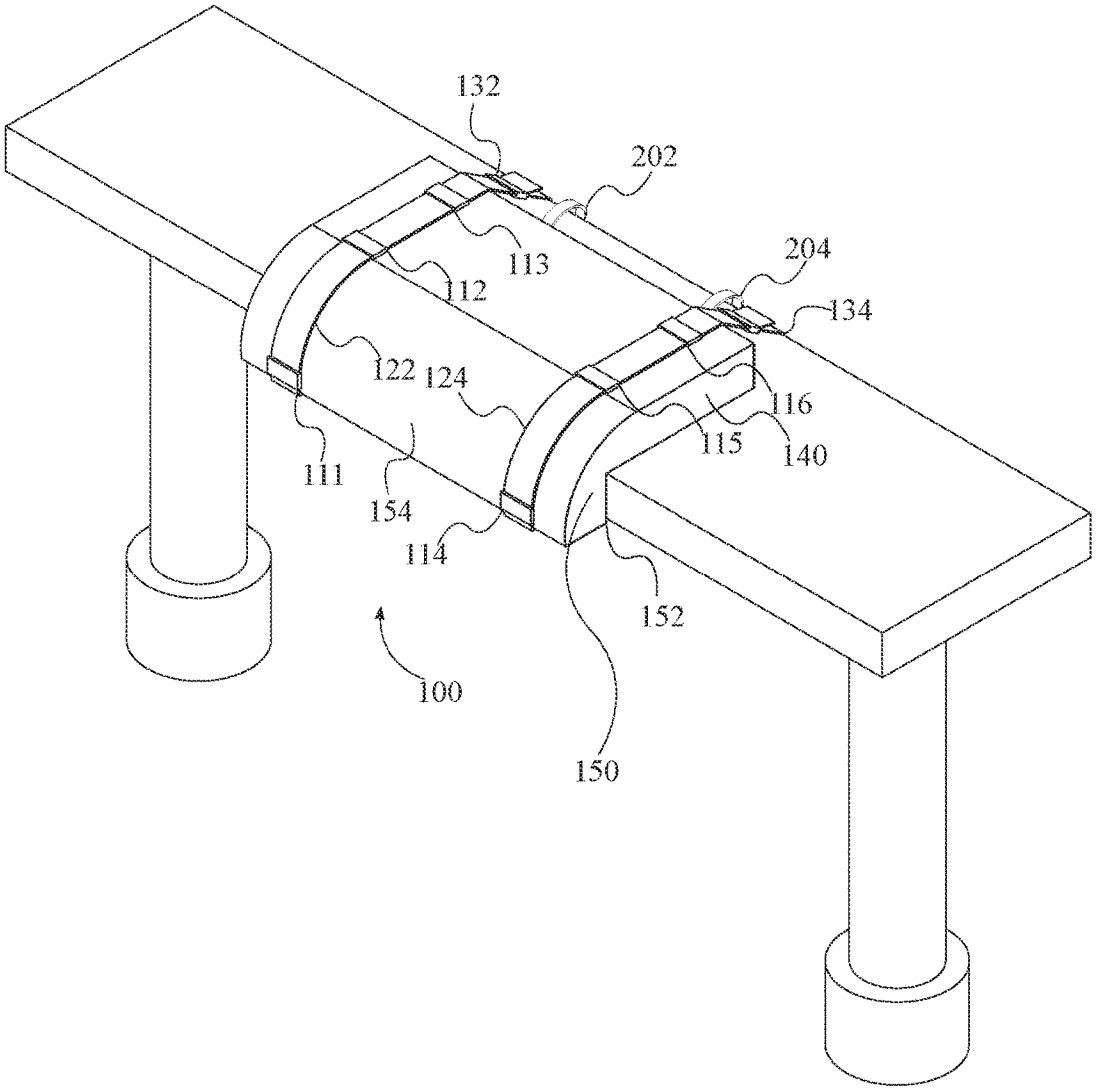
FIG. 1 shows a top front perspective view of the present invention as attached to an existing weight bench.
Figure 2:
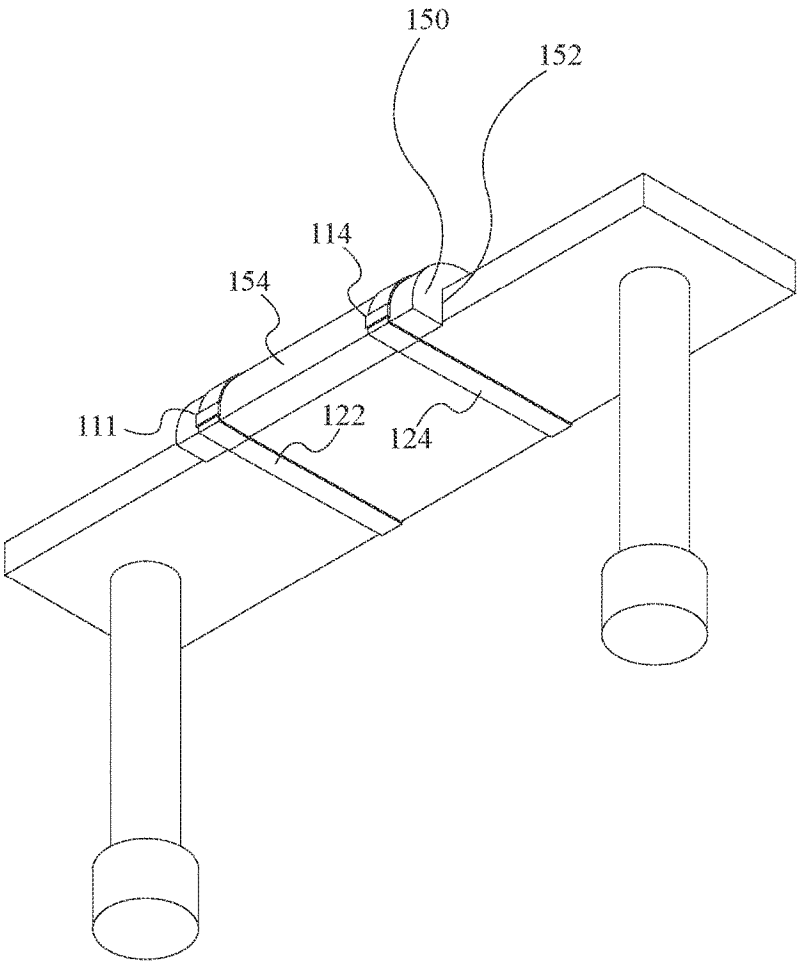
FIG. 2 shows a view of the bottom front perspective of the present invention.

In the ideal embodiment, the support pad 100 is in an L-shape that may further comprise a 3.5-inch radius lip 150, the lip 150 defining the L-shape of the support pad 100 on the bottom of the support pad. The lip 150 may comprise an inner portion 152 and an outer portion 154. In the ideal embodiment, the inner portion 152 of the lip 150 comprises the L-shape, and the outer portion 154 of the lip 150 may comprise a curved surface. The lip 150 is intended to fit snugly over the edge of an existing weight bench or workout assembly (as seen in FIG. 1-2). The padding 140 in this area comprises the same soft but dense material of the rest of the support pad 100. Other sizes and radii of the lip 150 are contemplated to adapt to a variety of different size workout benches and assemblies.

The present invention further comprises an attachment mechanism. In the ideal embodiment, the attachment mechanism comprises two heavy-duty nylon straps, comprising a first strap 122 and a second strap 124. Each of the nylon straps further an adjustment buckle. The two heavy-duty nylon straps are threaded through a securing loop on the body of the support pad 100. In the ideal embodiment, there are two sets of three vinyl securing loops, comprising a first set of loops and a second set of loops, with one set being positioned on each side of the body of the pad. The first set of loops may comprise a first loop 111, a second loop 112, and a third loop 113. The second set of loops may comprise a fourth loop 114, a fifth loop 115, and a sixth loop 116. In the ideal embodiment, each set of loops may positioned to be vertically aligned, such that each loop in each loop set are in the same longitudinal position on the pad with variance in the latitudinal position of the loops, as shown in FIG. 1. It should be understood that other variations in the placement and distribution of the attachment mechanism are within the spirit and scope of the invention.

Figure 3:
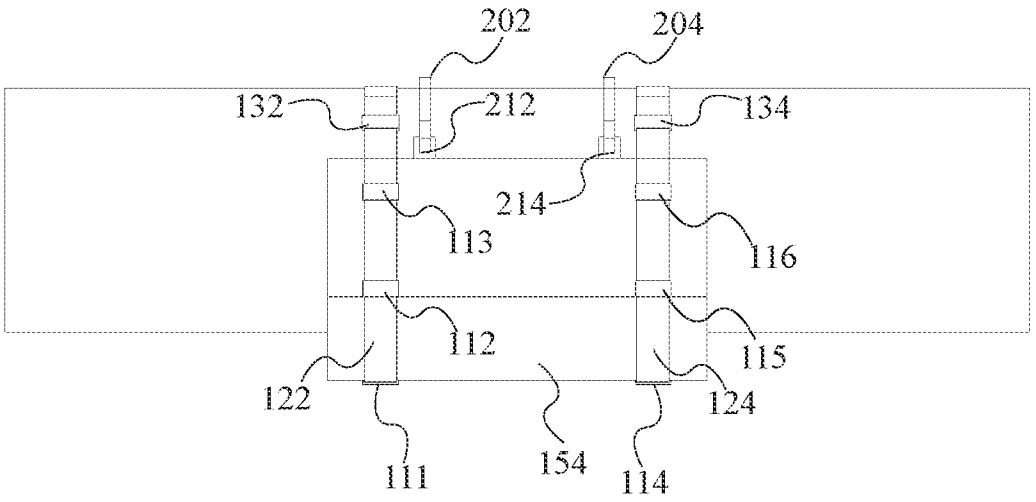
FIG. 3 shows a view of the top of the present invention.
Figure 4:
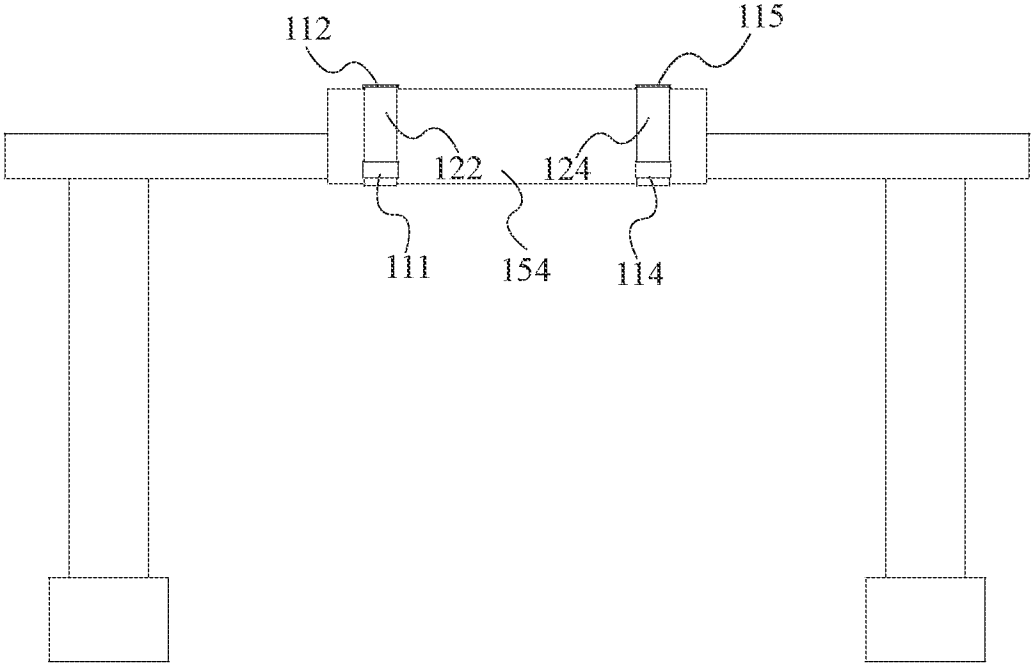
FIG. 4 shows a view of the front side of the present invention.
Figure 5:
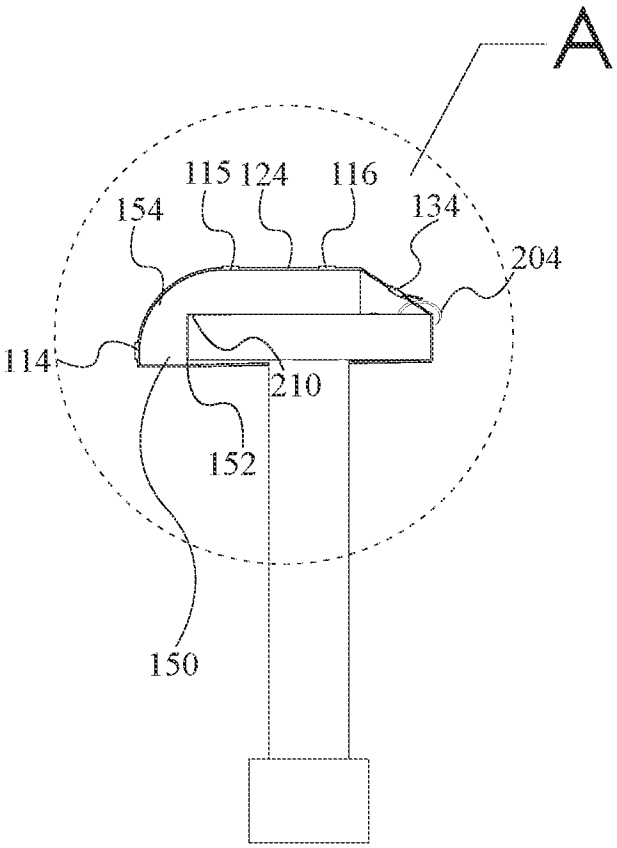
FIG. 5 shows a view of the right side of the present invention.
Figure 6:
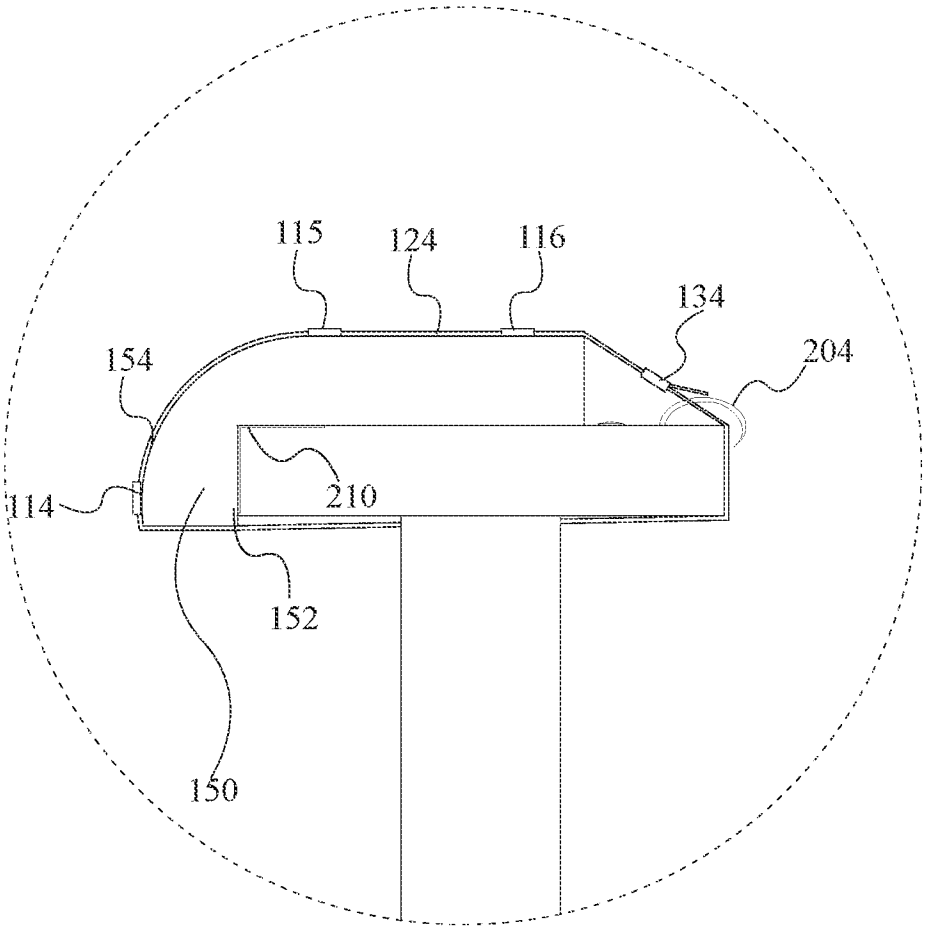
FIG. 6 shows a magnified view of section A from FIG. 5.
Figure 7:
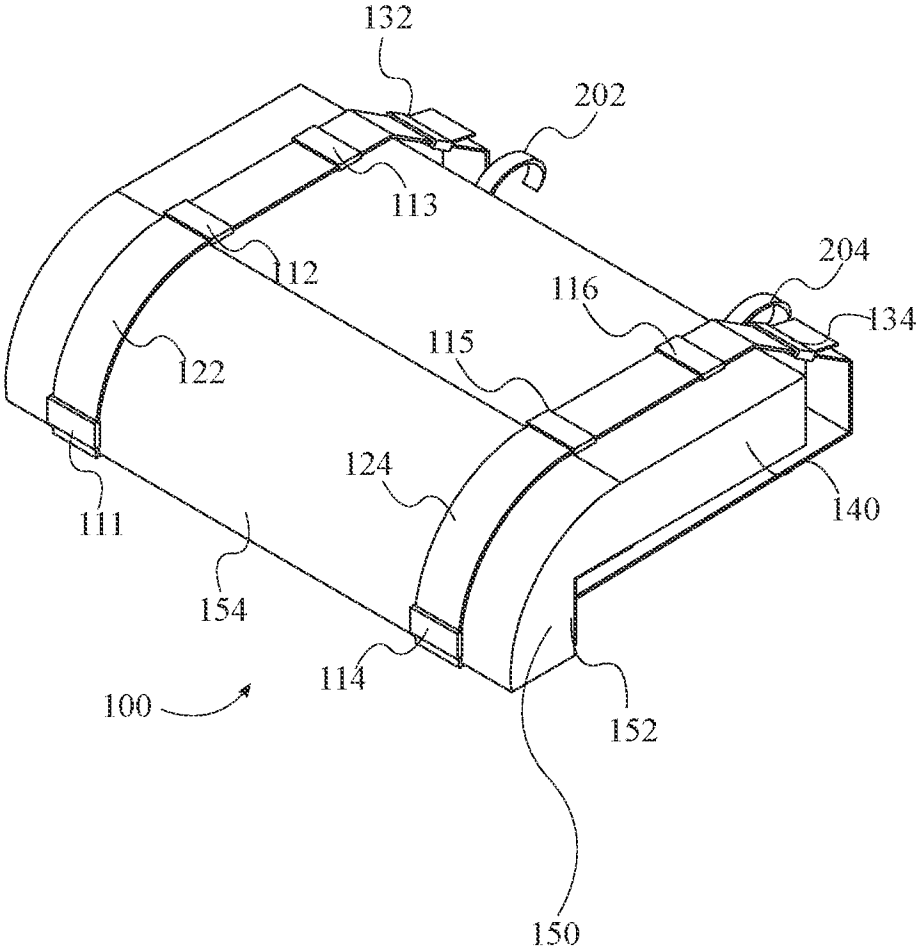
FIG. 7 shows a top front perspective view of the present invention not attached to any other assemblies.

The securing loop may be sewn onto the body of the pad during manufacture. In the ideal embodiment, each side of the body of the support pad 100 has two securing loops on the top of the pad and one securing loop on the front of the pad. As shown in FIG. 1, FIG. 3, and FIG. 7, for example, referring to the first set of loops, the first loop 111 may be positioned on the outer portion 154 of the lip 150, while the second loop 112 and third loop 113 may be positioned on the top side of the body of the pad, the second loop 112 being positioned between the first loop 111 and third loop 113, as shown in FIG. 1. Likewise, referring to the second set of loops, the fourth loop 114 may be positioned on the outer portion 154 of the lip 150, while the fifth loop 115 and sixth loop 116 may be positioned on the top side of the body of the pad, the fifth loop 115 being positioned between the fourth loop 114 and sixth loop 116, as shown in FIG. 1. One of the nylon straps is threaded through the three securing loops on one side of the pad, and the second nylon strap is threaded through the three securing loops on the opposite side of the pad. In the ideal embodiment, the first strap 122 is threaded through the first loop set, and the second strap 124 is threaded through the second loop set. The nylon straps can be completely removed from the pad for ease of cleaning and transportation. Nylon is chosen as a material because it is standard for use in workout equipment, being durable, long-lasting, and easy to clean. Other configurations, arrangements, and numbers of the securing loops or attachment mechanism s are contemplated in alternate embodiments. Other materials that have similar properties are contemplated for use in alternate embodiments.

The adjustment buckle is intended to allow the user to adjust and secure the pad to weight benches and assemblies of varying sizes, the adjustment buckle being operatively connected to the attachment mechanism. The user may pull the nylon straps tight, then secure the straps in place using the adjustment buckle. The adjustment buckle may comprise a clasp, fastener, or any other means which allows the length of the straps to be adjusted, then pulled taut and then securely fastened to the surface. The adjustment buckle may comprise any material that is durable and allows secure fastening of the straps, such as hard plastic or metal. In the ideal embodiment, the adjustment buckle is secured onto the attachment mechanism, such as by sewing, tying, or otherwise fastening the adjustment buckle to the attachment mechanism. In the ideal embodiment, the adjustment buckle may comprise a first buckle 132 and a second buckle 134. The first buckle 132 may be operatively connected to the first strap 122, and the second buckle 134 may be operatively connected to the second strap 124. Though the component is described as an adjustment buckle, it should be contemplated that any other adjustment mechanism that is well-known in the art is within the spirit and scope of the present invention.

Other attachment and adjustment mechanisms that perform a similar function of allowing the pad to be securely attached to and detached from an existing surface or assembly are contemplated by alternative embodiments.

Referring now to FIGS. 5-9, in some embodiments, the present invention may further comprise a corner bracket 210 and an auxiliary attachment device to assist in attaching the support pad 100 to a weight bench or other similar surface.

Figure 9:
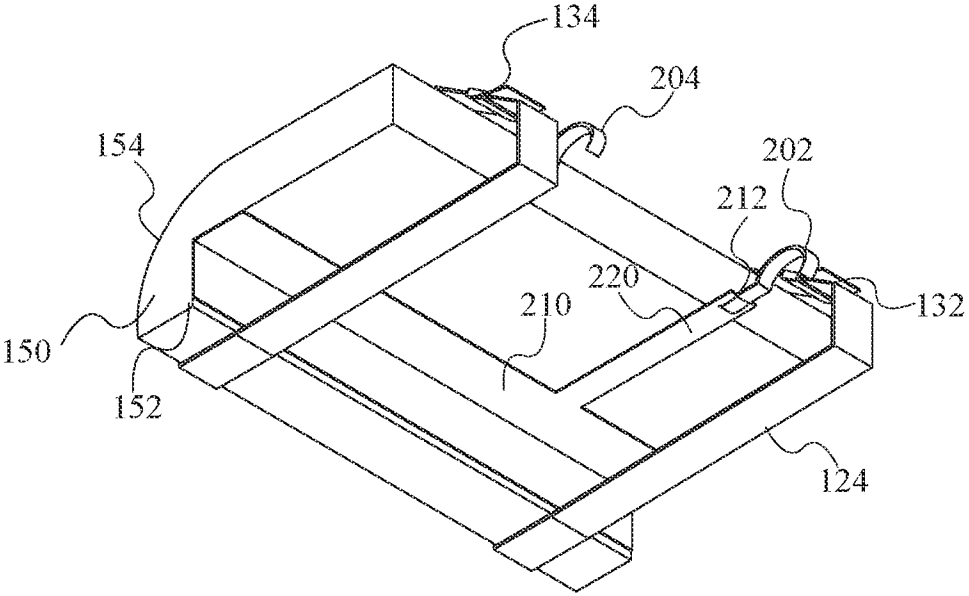
FIG. 9 shows a bottom rear perspective view of the present invention not attached to any other assemblies.

The corner bracket 210 may comprise a plastic, metal, or similar material bracket that is adapted to connect to the inner portion 152 of the pad, as shown in FIG. 9. The bracket may comprise a non-slip material to assist in keeping the pad steady on the weight bench or surface. The corner bracket 210 may be detachably attachable to, or may be integral to the body of the support pad 100.

Figure 8:
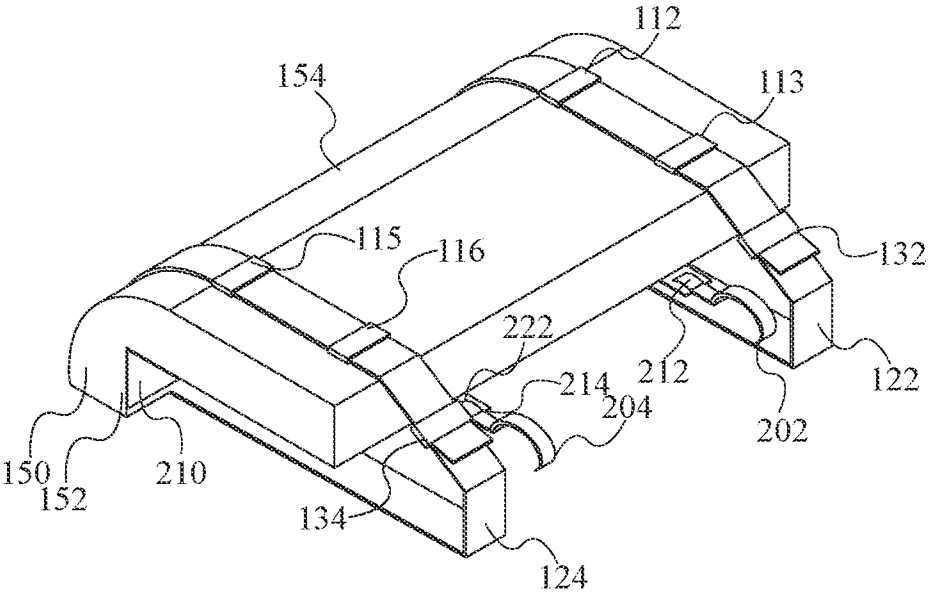
FIG. 8 shows a top rear perspective view of the present invention not attached to any other assemblies.

The auxiliary attachment device may comprise an auxiliary strap, each auxiliary strap being attached at one end to an auxiliary hook. The auxiliary hook can assist in latching the pad onto a weight bench or other surface to help anchor the support pad 100 in place. In the ideal embodiment, the support pad 100 may comprise a first auxiliary strap 220, a second auxiliary strap 222, a first auxiliary hook 202, and a second auxiliary hook 204. The first auxiliary strap 220 may be attached to the first auxiliary hook 202, and the second auxiliary strap 222 may be attached to the second auxiliary hook 204, as seen in FIG. 8 and FIG. 9. In the ideal embodiment, the auxiliary attachment device may further comprise an auxiliary adjustment device being operatively connected to the auxiliary strap 220 to adjust the length of the auxiliary strap 220. In the ideal embodiment, the auxiliary adjustment device may comprise a first auxiliary buckle 212 and a second auxiliary buckle 214. The first auxiliary buckle 212 may be operatively connected to the first auxiliary strap 220, and the second auxiliary buckle 214 may be operatively connected to the second auxiliary strap 222.

Although the invention has been explained in relation to its preferred embodiment, it is to be understood that many other possible modifications and variations can be made without departing from the spirit and scope of the invention.

I claim:

1. A support pad comprising:
a body;
the body further comprising:
an attachment mechanism;
an adjustment buckle;
a lip;
a securing loop;
the adjustment buckle being operatively connected to the attachment mechanism;
the interior of the body further comprising a padding;
the lip comprising an inner portion and an outer portion;
the attachment mechanism comprising a first strap and a second strap;
the securing loop comprising a first loop set and a second loop set;
the first loop set comprising a first loop, a second loop, and a third loop; and
the second loop set comprising a fourth loop, a fifth loop, and a sixth loop.

2. The support pad of claim 1, further comprising:
the first strap being adapted to thread through each loop in the first loop set; and
the second strap being adapted to thread through each loop in the second loop set.

3. The support pad of claim 1, further comprising:
the third loop being positioned on the outer portion of the lip; and
the sixth loop being positioned on the outer portion of the lip.

4. The support pad of claim 1, further comprising:
the inner portion of the lip comprising an l-shape.

5. The support pad of claim 1, further comprising:
the outer portion of the lip comprising a curved surface.

6. The support pad of claim 1, further comprising:
an auxiliary attachment device;
a corner bracket; and
the auxiliary attachment device being attached to the corner bracket.

7. The support pad of claim 6, further comprising:
the corner bracket being of the same shape as the inner portion of the lip; and
wherein the corner bracket is attached to the inner portion of the lip.

8. The support pad of claim 7, further comprising:
the auxiliary attachment device further comprising a first auxiliary hook, a second auxiliary hook, a first auxiliary strap, and a second auxiliary strap.

9. The support pad of claim 1, further comprising:
the adjustment buckle further comprising a first buckle and a second buckle;
the first buckle being operatively connected to the first strap; and
the second buckle being operatively connected to the second strap.

10. The support pad of claim 8, further comprising:
the first auxiliary hook being attached to the first auxiliary strap; and
the second auxiliary hook being attached to the second auxiliary strap.

11. A support pad comprising:
a body;
the body further comprising:
an attachment mechanism;
an adjustment buckle;
a lip;
a securing loop;
the adjustment buckle being operatively connected to the attachment mechanism;
the interior of the body further comprising a padding;
the lip comprising an inner portion and an outer portion;
the outer portion of the lip comprising a curved surface;
the attachment mechanism comprising a first strap and a second strap;
a corner bracket;
the corner bracket being of the same shape as the inner portion of the lip;
wherein the corner bracket is attached to the inner portion of the lip;
an auxiliary attachment device; and
the auxiliary attachment device being attached to the corner bracket.

12. The support pad of claim 11, further comprising:
the securing loop comprising a first loop set and a second loop set;
the first loop set comprising a first loop, a second loop, and a third loop;
the second loop set comprising a fourth loop, a fifth loop, and a sixth loop;
the first strap being adapted to thread through each loop in the first loop set; and
the second strap being adapted to thread through each loop in the second loop set.

13. The support pad of claim 12, further comprising:
the third loop being positioned on the outer portion of the lip;
the sixth loop being positioned on the outer portion of the lip; and
the inner portion of the lip comprising an l-shape.

14. The support pad of claim 11, further comprising:
the adjustment buckle further comprising a first buckle and a second buckle;
the first buckle being operatively connected to the first strap; and
the second buckle being operatively connected to the second strap.

15. The support pad of claim 11, further comprising:
the auxiliary attachment device further comprising a first auxiliary hook, a second auxiliary hook, a first auxiliary strap, and a second auxiliary strap.

16. The support pad of claim 15, further comprising:
the first auxiliary hook being attached to the first auxiliary strap; and
the second auxiliary hook being attached to the second auxiliary strap.

17. A support pad comprising:
a body;
the body further comprising:
an attachment mechanism;
an adjustment buckle;
a lip;
a securing loop;
the attachment mechanism comprising a first strap and a second strap;
the securing loop comprising a first loop set and a second loop set;
the first loop set comprising a first loop, a second loop, and a third loop;
the second loop set comprising a fourth loop, a fifth loop, and a sixth loop;
the first strap being adapted to thread through each loop in the first loop set;
the second strap being adapted to thread through each loop in the second loop set;
the adjustment buckle being operatively connected to the attachment mechanism;
the adjustment buckle further comprising a first buckle and a second buckle;
the first buckle being operatively connected to the first strap;
the second buckle being operatively connected to the second strap;
the interior of the body further comprising a padding;
the lip comprising an inner portion and an outer portion;
the outer portion of the lip comprising a curved surface;
the third loop being positioned on the outer portion of the lip;
the sixth loop being positioned on the outer portion of the lip;
the inner portion of the lip comprising an l-shape;
an auxiliary attachment device;
the auxiliary attachment device further comprising a first auxiliary hook, a second auxiliary hook, a first auxiliary strap, and a second auxiliary strap;
a corner bracket;
the corner bracket being of the same shape as the inner portion of the lip;
wherein the corner bracket is attached to the inner portion of the lip;
the auxiliary attachment device being attached to the corner bracket;
the first auxiliary hook being attached to the first auxiliary strap; and
the second auxiliary hook being attached to the second auxiliary strap.

* * * * *